United States Patent [19]

Clayton

[11] 4,055,938

[45] Nov. 1, 1977

[54] OPEN-END SPINNING

[75] Inventor: James William Barnes Clayton, Accrington, England

[73] Assignee: Platt Saco Lowell Limited, Rossendale, England

[21] Appl. No.: 739,807

[22] Filed: Nov. 8, 1976

[30] Foreign Application Priority Data

Nov. 13, 1975 United Kingdom ..... 46840/75

[51] Int. Cl.[2] ..... D01H 1/12

[52] U.S. Cl. ..... 57/58.89

[58] Field of Search ..... 57/58.89–58.95, 57/106, 90, 34 HS, 62

[56] References Cited

U.S. PATENT DOCUMENTS

| | | | |
|---|---|---|---|
| 3,210,923 | 10/1965 | Schlosser | 57/50 X |
| 3,645,081 | 2/1972 | Salama | 57/34 HS |
| 3,831,360 | 8/1974 | Horvath | 57/34 HS X |
| 3,831,362 | 8/1974 | Dudzik | 57/34 HS |
| 3,834,145 | 9/1974 | Ellingham et al. | 57/58.95 X |
| 3,971,200 | 7/1976 | Richter | 57/34 HS |

*Primary Examiner*—John Petrakes

[57] ABSTRACT

Apparatus for open-end spinning textile yarns comprises fibre feed means, spinning means to receive fibres from the fibre feed means and to spin them into a tail end of yarn for continuous withdrawal of yarn from the spinning means, and yarn withdrawal means to withdraw the yarn along a yarn withdrawal axis to a yarn delivery aperture of the spinning means and to form the yarn into a package. The yarn withdrawal means comprises a package forming assembly and a yarn engaging means. The package forming assembly is operative to form a package of the yarn and has yarn distributing guide means to distribute the yarn on the package. The yarn engaging means is operative to engage the yarn in its passage between the yarn delivery aperture and the yarn distributing guide means. The yarn engaging means and the yarn distributing guide means are mounted on opposite sides of a plane containing the yarn withdrawal axis in such disposition that the distance travelled by the yarn from the yarn engaging means to the yarn distributing guide means is greater than the distance from the yarn delivery aperture to the yarn distributing guide means.

17 Claims, 2 Drawing Figures

OPEN-END SPINNING

Figure 1:
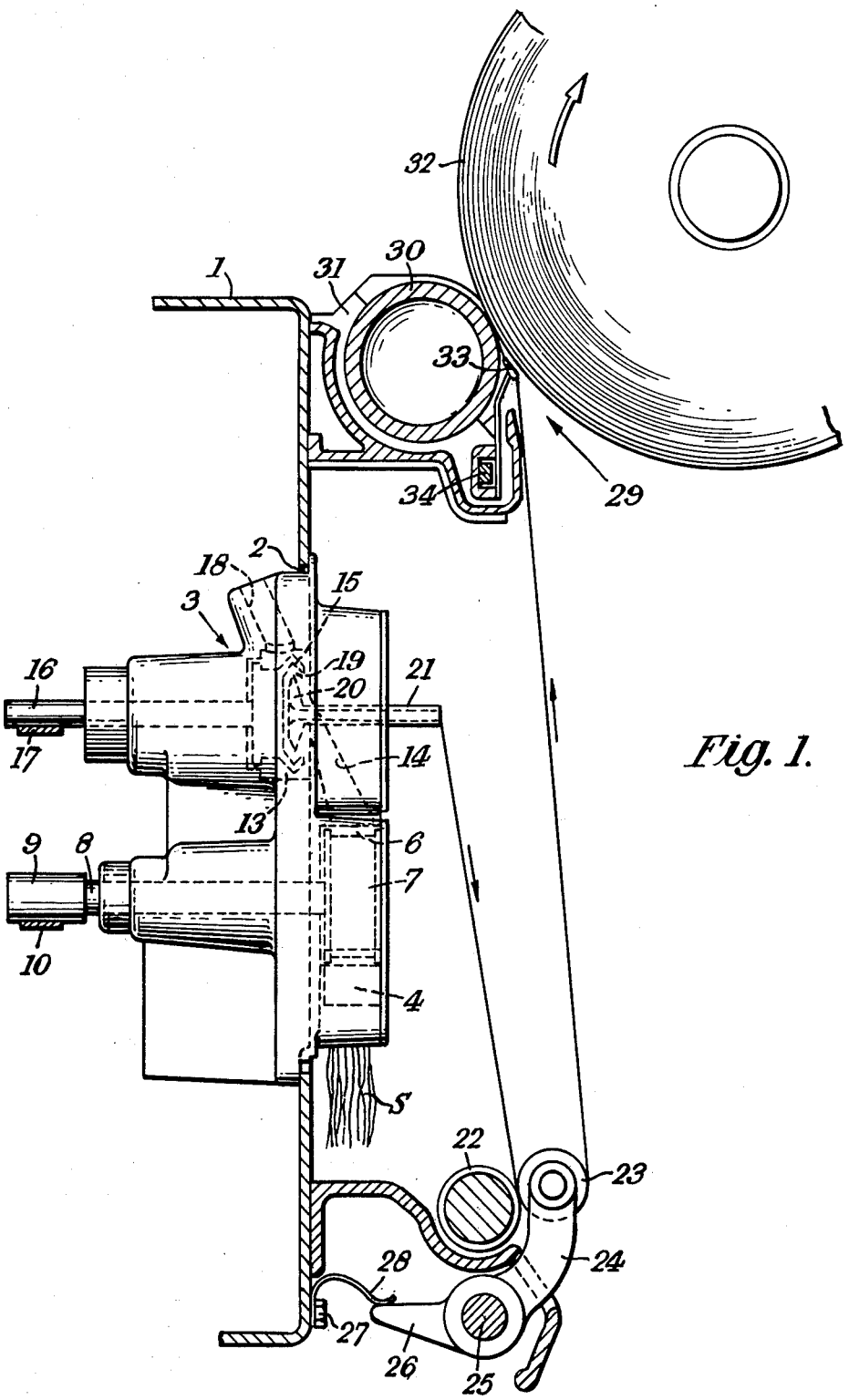

This invention relates to improvements in apparatus for open-end spinning textile yarns.

Open-end spinning apparatus conventionally comprises fibre feed means, spinning means for receiving fibres fed from the fibre feed means and spinning them into a tail end of yarn, yarn delivery rollers for withdrawing the spun yarn through a yarn delivery aperture of the spinning means, and a package forming assembly for packaging the withdrawn yarn.

The spinning means is usually constituted by a spinning rotor having an internal fibre collecting surface for accumulating fibres fed thereto but in another form of open-end spinning apparatus the spinning means may be constituted by gaseous or liquid vortex created within a stationary tubular member. In either case the tail end of yarn is constrained by the yarn delivery aperture as it rotates about an axis of rotation so that fibres are picked up and twisted into the newly formed yarn.

In such open-end spinning machines it is desirable that the spinning means, yarn delivery rollers and package forming assembly are so positioned that they are readily accessible to a machine operative particularly in relation to their height above floor level. In presently known configurations the yarn delivery rollers and the package forming assembly have both been located either above or below the spinning means. In order to achieve the height necessary for good accessibility it has been necessary to locate the delivery rollers and the package forming assembly close to one another. Consequently, only a short length of yarn extends between the delivery rollers and the take-up package.

In practice it has been found that this short length results in large variations in the yarn tension as the package is formed because of the large angle subtended by the paths of yarn extending from the nip point at the delivery rollers to the axial limits of the yarn traversing means.

According to the invention there is provided an apparatus for open-end spinning textile yarns comprising fibre feed means, spinning means to receive fibres from the fibre feed means and to spin them into a tail end of yarn for continuous withdrawal of yarn from the spinning means, yarn withdrawal means to withdraw the yarn along a yarn withdrawal axis to a yarn delivery aperture of the spinning means and to form the yarn into a package, said yarn withdrawal means comprising a package forming assembly and a yarn engaging means, said package forming assembly being operative to form a package of the yarn and having yarn distributing guide means to distribute the yarn on the package, said yarn engaging means being operative to engage the yarn in its passage between the yarn delivery aperture and the yarn distributing guide means, and said yarn engaging means and said yarn distributing guide means being mounted on opposite sides of a plane containing the yarn withdrawal axis in such disposition that the distance travelled by the yarn from the yarn engaging means to the yarn distributing guide means is greater than the distance from the yarn delivery aperture to the yarn distributing guide means.

The yarn withdrawal axis may be a real axis along which the yarn is longitudinally withdrawn or a virtual axis about which the tail end of yarn rotates while being withdrawn.

Preferably, the spinning means comprises a spinning rotor arranged for rotation about the yarn withdrawal axis. For best advantage, the yarn engaging means are constituted by yarn delivery rollers and are arranged substantially radially opposite to the package forming assembly relative to the yarn withdrawal axis.

According to a preferred aspect of the invention the spinning rotor is forwardly facing with the yarn delivery rollers arranged vertically below the yarn withdrawal axis and the yarn distributing guide means arranged vertically above the yarn withdrawal axis.

Preferably the yarn withdrawal axis lies in a horizontal plane.

Figure 2:
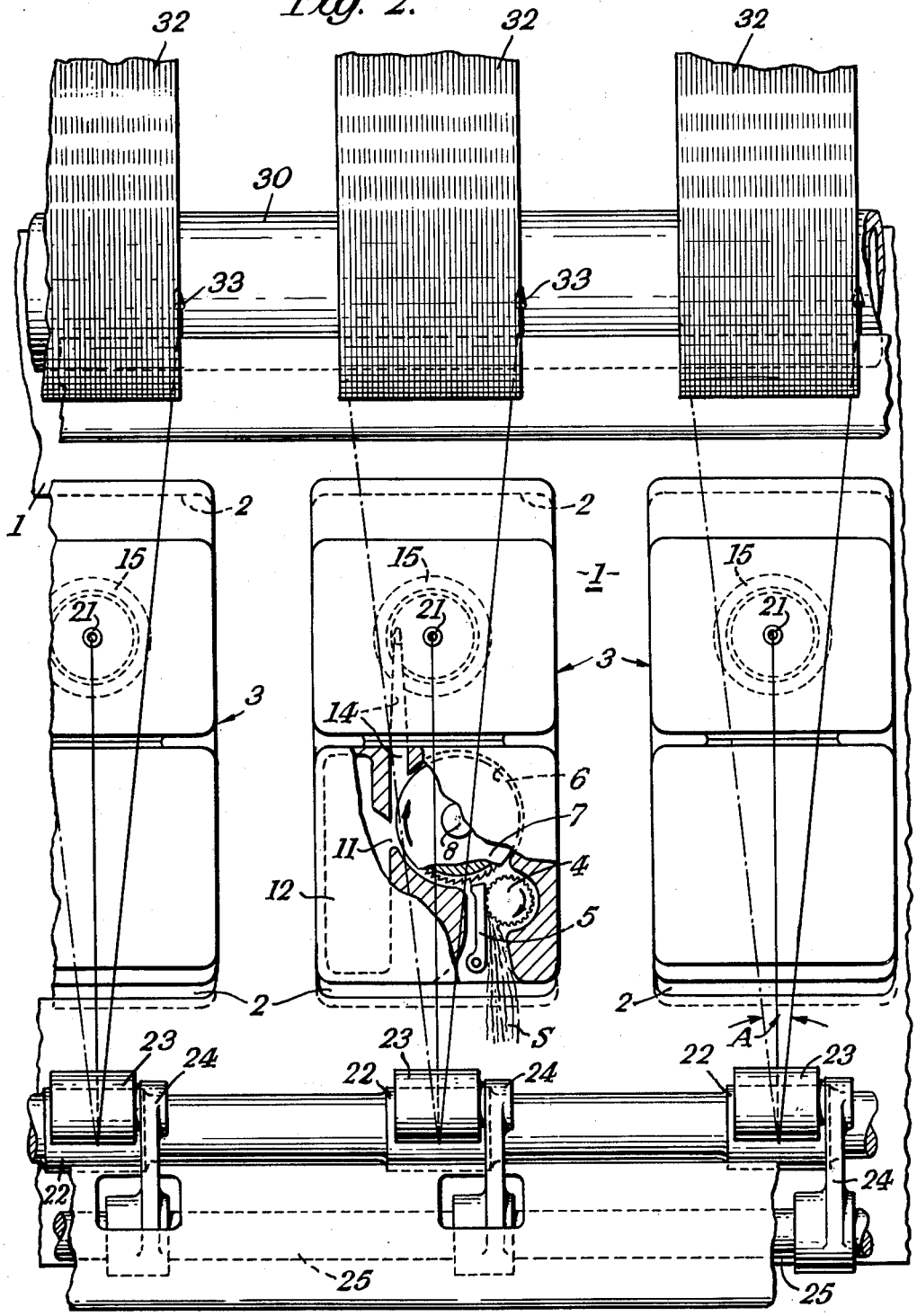

The invention will now be more particularly described with reference to the accompanying drawings, in which:

FIG. 1 is a sectional side elevation of an open-end spinning station according to one embodiment of the invention; and FIG. 2 is a front elevation of the spinning station shown in FIG. 1.

Referring to the drawings a machine frame element 1 extends along the length of an open-end spinning machine and has formed in a front face thereof a plurality of spaced apertures 2 each of which serves for the location of a spinning unit housing 3.

In a lower portion of the housing 3 is mounted a rotatable feed roller 4 which co-operates with a pivotally mounted feed plate 5 to form therewith a sliver forwarding nip. The housing 3 is formed with a cavity 6 in which an opening roller 7 is arranged for rotation. The peripheral surface of the opening roller 7 is provided with needles or saw-tooth type card wire to perform an opening action on the fibrous material forwarded by the sliver forwarding nip. The opening roller 7 is fixedly attached to a horizontally arranged shaft 8 rotatably supported in bearings (not shown). The shaft 8 extends beyond the rear of the housing 3 and terminates in a driving element 9 frictionally engaging a driving belt 10 extending along the machine and similarly engaging the opening roller driving elements at the remaining stations. Communicating with the cavity 6 via an aperture 11 is a chamber 12 serving to accumulate any impurities ejected by centrifugal action from the fibrous material being conveyed on the periphery of the opening roller 7.

In the upper portion of the housing 3 is a chamber 13 between which and the cavity 6 extends a fibre feed duct 14. Within the chamber 13 a spinning rotor 15 is located which is fixedly mounted on a horizontally arranged shaft 16 extending beyond the rear of the housing 3 so as to provide a shaft portion engageable with a driving belt 17. The driving belt 17 extends along the machine and serves to drive the remainder of the spinning rotor shafts. Communicating with the chamber 13 is a suction duct 18 to which, in operation, suction is applied in order to create a sub-atmospheric condition in the chamber 13 and thereby set up a fibre conveying airstream along the fibre feed duct 14.

The spinning rotor 15 defines a cavity 19 which has a forwardly facing open top through which protrudes a separator member 20. The separator member 20 has a tubular extension co-axial with the spinning rotor 15 and terminating in a yarn delivery aperture 21 through which yarn is withdrawn from the cavity 19 of the rotor 15 out through the front of the housing 3.

Situated below the housing 3 is a pair of yarn delivery rollers comprising a driving roller 22 which extends along the machine and serves as a yarn delivery roller for the remainder of the spinning stations, and a driven roller 23. The driven roller 23 is rotatably mounted on a bracket 24 arranged for pivotal movement on a shaft 25. A projection 26 is provided on the bracket 24 and is engaged by a leaf spring 28 secured to the machine frame 1 by screws 27 to bias the driven roller 23 into contact with the driving roller 22.

Situated above the housing 3 is a package forming assembly 29 comprising a package driving roller 30 extending along the machine and supported at spaced intervals by bearings 31. The driving roller 30 frictionally engages a yarn package 32 to impart rotation thereto. A yarn distributing guide 33 is fixedly attached to a bar 34 which, in operation, reciprocates to distribute the yarn issuing from the delivery rollers 22, 23 on the package 32. The yarn distributing guide 33 may, if desired, be replaced by a grooved yarn distributing drum.

In operation a sliver S is forwarded by the sliver forwarding nip formed between the feed plate 5 and feed roller 4 to the fibre opening roller 7. The needles or saw-tooth type card wire perform an opening action on the fibres and convey them to the entrance of the fibre feed duct 14. Impurities contained in the fibres are ejected therefrom through aperture 11 and collected in the collecting chamber 12. The fibres are conveyed in an airstream along the fibre feed duct 14 and into the cavity 19 of the spinning rotor 15 where they are accumulated at the maximum diameter thereof. The fibres are twisted into the tail end of the newly formed yarn rotating about the axis of rotation of the spinning rotor and withdrawn along a yarn withdrawal axis through the yarn delivery aperture 21, by the delivery rollers 22, 23 mounted below the housing 3. The yarn emerging from the yarn delivery aperture 21 passes to the nip formed by the delivery rollers 22, 23 in a vertical plane passing through the axis of rotation of the spinning rotor. After passing in an arcuate path around the delivery roller 23 the yarn doubles back so as to travel upwardly to the package forming assembly 29 where it is formed into a package 32 which is symmetrical with respect to the aforesaid vertical plane by means of reciprocating traverse guide 33. If desired, the delivery rollers 22, 23 and/or the package 32 may be offset with regard to the vertical plane. The angle subtended around the delivery roller 23 is in the region of 180° such that the path of yarn extending between the yarn outlet aperture 21 and the nip formed by delivery rollers 22, 23 is approximately parallel to the path of yarn extending between the said nip and yarn distributing guide 33 as best seen in FIG. 1.

The disposition of the spinning means, yarn delivery rollers and package forming assembly is such that the yarn delivery rollers 22, 23 and the yarn distributing guide 33 are arranged on opposite sides of the horizontal plane passing through the axis of rotation of the rotor and the yarn withdrawal axis and is such that the distance travelled by the yarn from the delivery rollers 22, 23 to the yarn distributing guide 33 is greater than the distance between the yarn delivery aperture 21 and the yarn distributing guide 33. In this way a compact arrangement is formed. Although a sufficient length of yarn extending between the yarn delivery rollers and the yarn distributing guide is provided such that the tension is not varied by an excessive amount, this has been achieved without placing the package forming assembly out of reach of a machine operative. The angle 'A' subtended by the yarn paths extending from the delivery rollers to the axial limits should not exceed 25° and is preferably within the range of 14° to 20°. Operation under such conditions is conducive to the formation of satisfactory packages.

In an alternative embodiment the package forming assembly 29 is mounted below the spinning means with the yarn delivery rollers mounted above.

In a further alternative embodiment the delivery rollers 22, 23 may be replaced at the same position by a yarn guide which may be stationary so as to engage the yarn in its passage between the yarn delivery aperture and the yarn distributing guide and the withdrawal of yarn from the spinning means effected solely by the package forming assembly.

What we claim as our invention and desire to secure by Letters Patent is:

1. Apparatus for open-end spinning textile yarns, comprising a longitudinally extending machine frame, a plurality of spinning units mounted at spaced intervals along said machine frame, each said spinning unit including fibre feed means and spinning means for receiving fibres from the fibre feed means and spinning them into a tail end of yarn for continuously withdrawal of yarn from the spinning means, yarn withdrawal means for withdrawing the yarn along a yarn withdrawal axis to a yarn delivery aperture of the spinning means and forming the yarn into a package, said yarn withdrawal means comprising a package forming assembly for forming a package of the yarn and having yarn distributing means for distributing the yarn on the package and yarn engaging means to engage the yarn in its passage between the yarn delivering aperture and the yarn distributing means, wherein the yarn engaging means and the yarn distributing guide means are arranged on opposite sides of the spinning unit and wherein the distance travelled by the yarn from the yarn engaging means to the yarn distributing means is greater than the distance from the yarn delivery aperture to the yarn distributing guide means.

2. Apparatus according to claim 1, wherein the yarn engaging means and the package forming assembly are mounted on opposite sides of a horizontal plane passing through the said yarn withdrawal axis.

3. Apparatus according to claim 2, wherein the yarn engaging means is mounted radially or substantially radially opposite to the package forming assembly relative to the yarn withdrawal axis.

4. Apparatus according to claim 2, wherein the package forming assembly with said yarn distributing guide means is mounted above the spinning means and the yarn engaging means is mounted below the spinning means.

5. Apparatus according to claim 2, wherein the package forming assembly with said yarn distributing guide means is mounted below the spinning means and the yarn engaging means is mounted above the said spinning means.

6. Apparatus according to claim 1, wherein the path of the yarn in travelling from the yarn delivery aperture to the yarn engaging means is parallel or substantially parallel to the path of the yarn travelling from the yarn engaging means to the yarn distributing guide means.

7. Apparatus according to claim 1, wherein the length of yarn extending between the yarn engaging means and the yarn distributing guide means is such as to produce substantially no variation in tension in the yarn during a traverse of the yarn from one axial limit of the package to the other.

8. Apparatus according to claim 1, wherein the angle between the path of the yarn extending from the yarn engaging means to one axial limit of the package and the path of the yarn extending from the yarn engaging means to the other axial limit of the package does not exceed 25°.

9. Apparatus according to claim 8, wherein the said angle lies within the range 14° to 20°.

10. Apparatus according to claim 1, wherein the spinning means comprises a spinning rotor mounted for rotation about an axis of symmetry coincident with the yarn withdrawal axis.

11. Apparatus according to claim 10, wherein the spinning means includes a yarn delivery duct terminating in said yarn delivery aperture and operative to guide the yarn from the spinning rotor to said delivery aperture along said yarn withdrawal axis.

12. Apparatus according to claim 10, wherein the spinning rotor is forwardly facing to withdraw the yarn forwardly along said yarn withdrawal axis to said yarn delivery aperture.

13. Apparatus according to claim 1, wherein the yarn engaging means comprises yarn delivery rollers.

14. Apparatus according to claim 13, wherein the yarn is arranged to pass round one of the delivery rollers in contact therewith over an arc subtending an angle of 180° or substantially 180°.

15. Apparatus according to claim 1, wherein the yarn engaging means comprises a stationary yarn guide and wherein the package forming assembly comprises the sole means for the withdrawal of yarn from the spinning means.

16. Apparatus according to claim 1, wherein the yarn distributing guide means comprises a reciprocatory yarn guide operative to execute a reciprocatory parallel package building motion.

17. Apparatus according to claim 16, wherein the yarn delivery rollers and the package forming assembly are mounted symmetrically with the respect to a vertical plane passing through the yarn withdrawal axis with the yarn distributing guide being operative to execute said reciprocatory motion symmetrically with respect to said vertical plane.

* * * * *